US007179051B2

(12) United States Patent
Williams et al.

(10) Patent No.: US 7,179,051 B2
(45) Date of Patent: Feb. 20, 2007

(54) METHOD OF DIE CASTING COMPRESSOR HOUSINGS

(75) Inventors: Bryan Williams, Camas, WA (US); Mike Flynn, Portland, OR (US); Glen Tompkins, Portland, OR (US)

(73) Assignee: Consolidated Metco. Inc., Portland, OR (US)

( * ) Notice: Subject to any disclaimer, the term of this patent is extended or adjusted under 35 U.S.C. 154(b) by 148 days.

(21) Appl. No.: 10/992,355

(22) Filed: Nov. 19, 2004

(65) Prior Publication Data

US 2006/0110249 A1 May 25, 2006

(51) Int. Cl.
*F04D 29/42* (2006.01)

(52) U.S. Cl. ..... 415/204; 415/206; 415/214.1

(58) Field of Classification Search ..... 415/204, 415/206, 214.1, 215.1, 224.5
See application file for complete search history.

(56) References Cited

U.S. PATENT DOCUMENTS 5,899,662 A * 5/1999 Hojyo et al. ..... 415/206

6,193,463 B1 2/2001 Adeff et al.

* cited by examiner

*Primary Examiner*—Ninh H. Nguyen
(74) *Attorney, Agent, or Firm*—Edward J. Brosius

(57) ABSTRACT

A compressor housing is provided for a compressor impeller. The compressor housing comprises an outer shell including an outer section, a midsection, and a center section. The midsection of the outer shell forms an upper volute wall portion of the compressor housing, and the center section forms an inlet for the compressor housing. A diffuser is also provided that is comprised of a center section, a base section, and an outer section. The center section of the diffuser has a substantially cylindrical outer edge received within a complementary substantially cylindrical mating surface in the outer shell center section. The diffuser base section has a raised first mating projection for engagement with the first mating surface of the midsection of the outer shell. The diffuser outer section has a raised second mating projection for engagement with a second mating surface of the midsection of the outer shell. A back plate is also provided that is formed of a generally circular structure. The diffuser base section has a generally flat lower surface for engagement with a generally flat upper surface of the back plate. The outer shell midsection, the diffuser and the back plate form the volute wall portion of a compressor housing.

31 Claims, 2 Drawing Sheets

METHOD OF DIE CASTING COMPRESSOR HOUSINGS

BACKGROUND OF THE INVENTION

The present invention relates generally to compressor housings for compressor impellers, and, more particularly, to a compressor housing comprised of an outer shell and a diffuser that together form a volute shape for the compressor housing.

Housings for compressors are typically made of cast aluminum due to the volute shape required in the compressor outlet duct for aerodynamic performance. Aluminum die casting is a very desirable process for production of such housings due to the inherent dimensional stability for such die cast parts. One die cast aluminum compressor housing is disclosed in U.S. Pat. No. 6,193,463.

SUMMARY OF THE INVENTION

A compressor housing is provided for a compressor impeller. The compressor housing comprises an outer shell including an outer section, a midsection, and a center section. The midsection of the outer shell forms an upper volute wall portion of the compressor housing, and the center section forms an inlet for the compressor housing. A diffuser is also provided that is comprised of a center section, a base section, and an outer section. The center section of the diffuser has a substantially cylindrical outer edge received within a complementary substantially cylindrical mating surface in the outer shell center section. The diffuser base section has a raised first mating projection for engagement with the first mating surface of the midsection of the outer shell. The diffuser outer section has a raised second mating projection for engagement with a second mating surface of the midsection of the outer shell. A back plate is also provided that is formed of a generally circular structure. The diffuser base section has a generally flat lower surface for engagement with a generally flat upper surface of the back plate. The outer shell midsection, the diffuser and the back plate form the volute wall portion of a compressor housing.

DETAILED DESCRIPTION OF THE INVENTION

Figure 1:
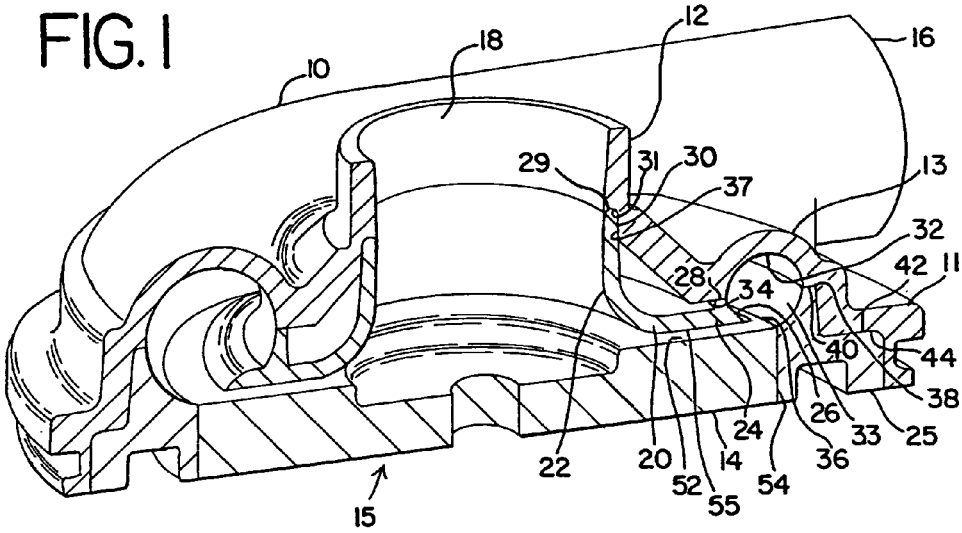
FIG. 1 is a perspective view in cross section of a compressor housing assembly in accordance with one embodiment of the present invention.

Referring to FIG. 1, a compressor housing in accordance with one embodiment of the present invention is shown generally at 15. Outer shell 10 is shown as unitary structure, usually comprised of a die cast aluminum piece. Although traditional foundry casting could also be utilized, outer shell 10 includes an outer section 11, a midsection 13, and a center section 12. Center section 12 is seen to be generally cylindrical in form, to provide air inlet 18. Air outlet 16 is seen to comprise the end section of a volute formed by the compressor housing assembly 15.

Outer section 11 is seen to be generally circular in structure with a peripheral surface 44 facing downwardly therefrom. The inner surface 32 of outer shell midsection 13 is seen to provide an outer wall of the volute formed by compressor housing assembly 15. Outer shell housing midsection 13 is also seen to include the generally flat mating surface 34 located adjacent outer wall 32. Outer shell housing midsection 13 also includes shelf-like mating surface 40 adjacent outer wall 32. Outer shell center section 12 is further seen to comprise an inner shell mating surface 31 that is generally circular in nature and is formed as an indent or shelf on the inner surface of outer shell center section 12.

Diffuser 20 is also usually formed of an aluminum die cast structure, but could be formed of aluminum cast in other manners such as traditional foundry casting. However, die casting is the preferred method of forming diffuser 20. Diffuser 20 is seen to comprise a center section 22, which is generally cylindrical in structure, a midsection 24 extending from center section 22. Diffuser 20 also is comprised of outer section 25 which in FIG. 1 is seen to be spaced from diffuser midsection 24. Diffuser outer section 25 is seen to provide a volute inner wall 33 that forms a portion of the volute structure provided by compressor housing assembly 15. Diffuser outer section 25 also comprises a mating projection 38 extending from volute inner wall 33 to engage mating surface 40 of outer shell midsection 13. Further, diffuser outer section 25 is seen to have a generally flat and circular upper peripheral surface 42 which is also to seen to engage downwardly facing peripheral surface 44 of outer section 11.

Diffuser midsection 24 includes first mating projection 28 extending upwardly from a position adjacent volute inner wall portion 26 formed by an inner surface of diffuser base section 24. Fist mating projection 28 of diffuser 20 is seen to engage a generally flat downwardly facing mating surface 34 of outer shell midsection 13.

Diffuser center section 22 is seen to be generally cylindrical in shape having an outer wall 30 that engages a complementary cylindrical cut portion 37 of outer shell housing center section 12. Further, diffuser 20 includes an inlet mating projection 29 that engages a shelf-like mating surface 31 of outer shell housing center section 12.

Back plate 14 is shown to be a generally flat, plate like structure having a generally circular outer circumference. Back plate 14 includes a generally flat upper surface 52 adjacent edge 54. Upper surface 52 of back plate 14 is seen to engage the lower surface 55 of diffuser base section 24. Back plate 14 itself is generally comprised of a die cast aluminum unitary piece, but could be formed of aluminum cast in a traditional foundry manner.

Figure 2:
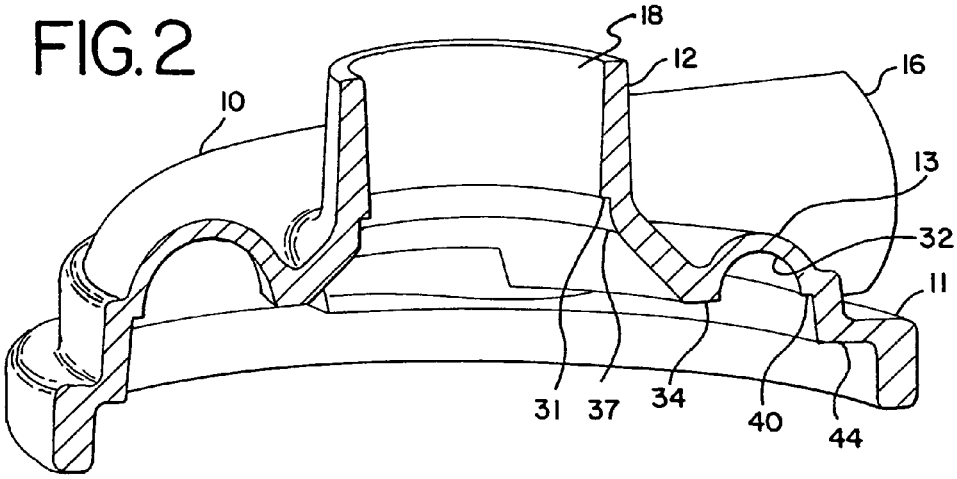
FIG. 2 is a perspective view in cross section of the outer shell of the compressor housing in accordance with one embodiment of the present invention.

Referring now to FIG. 2 of the drawings, outer shell 10 is shown as an aluminum die cast unitary structure before finish machining. Outer shell 16 is seen to comprise outer section 11, midsection 13, and generally cylindrical center section 12. Center section 12 is seen to form air inlet 18, extending from volute section formed by outer shell 10 is outlet 16. Midsection 13 is seen to form on its inner surface an outer wall 32 of the volute. Outer section 11 is seen to include peripheral downwardly surface 44. Midsection 13 is seen to include shelf-like mating surface 40 as well as generally flat mating surface 34 on either side of outer wall 32. Center section 12 is seen to include a shelf-like mating surface 31 as well as an inwardly formed receiving surface 37 that is generally cylindrical in nature.

Figure 3:
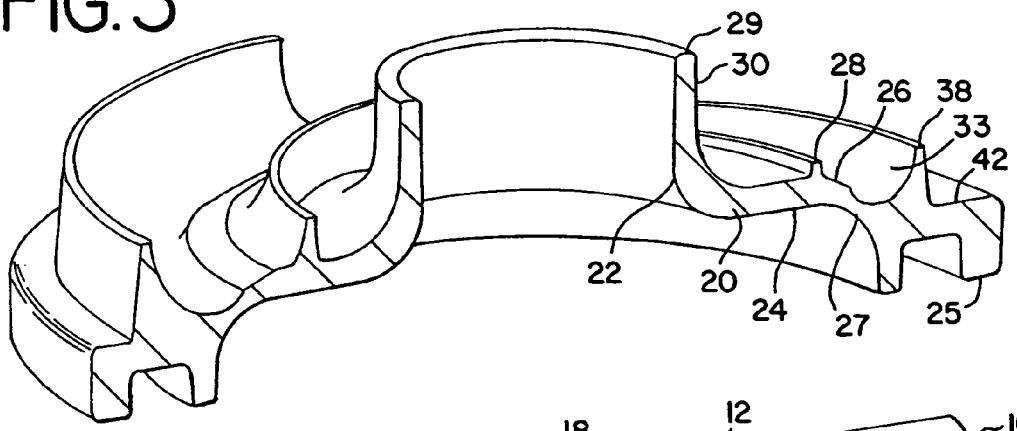
FIG. 3 is a perspective view in cross section of a diffuser as cast prior to machining in accordance with one embodiment of the present invention.

Referring now to FIG. 3, diffuser 20 is shown as a unitary die cast structure. Although die casting from aluminum is the preferred manufacturing method for diffuser 20, traditional foundry casting could also be utilized to produce the unitary aluminum structure. Diffuser 20 is seen to comprise outer section 25 of a generally circular configuration, base section 24, and center section 22. Center section 22 is seen to be generally cylindrical in structure, having an outer wall 30 and inlet mating projection 29 extending from the end of outer wall 30. Transition section 27 is seen to extend from diffuser base section to diffuser outer section 25, and thereby forming the unitary diffuser 20 in an as cast addition. It is understood that diffuser transition section 27 is removed in a finishing operation by means such as a lathe thereby forming diffuser 20 into two separate structures. One structure is comprised of center section 22 and base section 24, and the other structure is comprised of diffuser outer section 25.

Diffuser outer section 25 is seen to include peripheral surface 42 that is generally flat. Adjacent peripheral surface 42 is mating projection 38 extending upwardly and terminating in projection 38. Volute inner wall 33 is seen to be formed by the inner surface of diffuser outer section 25. Volute inner wall 26 is seen to be formed by a facing surface of diffuser base section 24. Finally, diffuser center section 22 is seen to terminate at an inlet mating projection 29 that forms the top edge of diffuser center section 22. Outer wall 30 diffuser center section 22 is seen to be cylindrical in structure.

Figure 4:
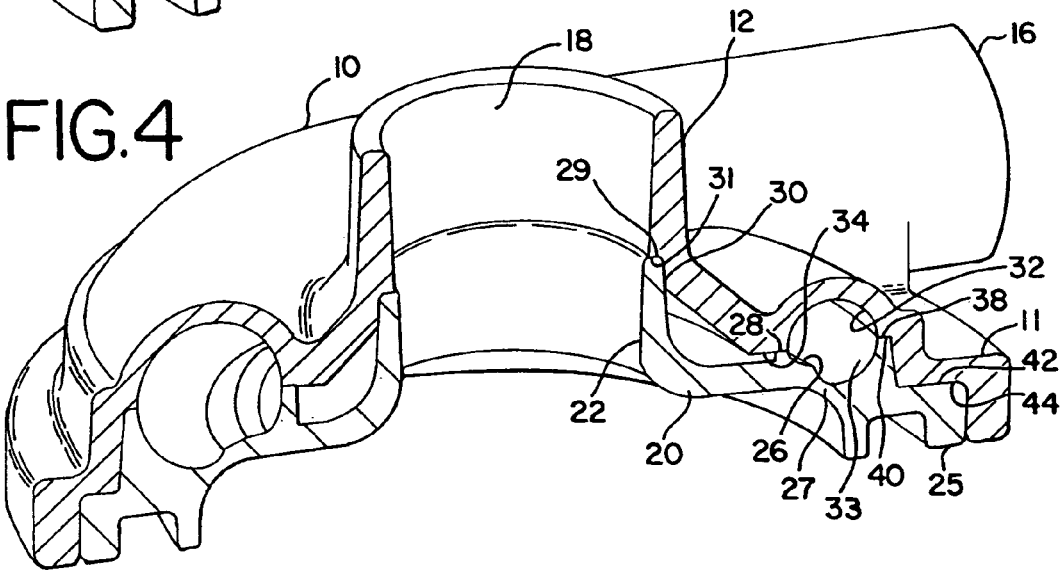
FIG. 4 is a perspective view in cross section of an assembled outer shell and diffuser prior to machining in accordance with one embodiment of the present invention.

Referring now to FIG. 4, diff-user 20 is seen to be fit into outer shell 10. Such fitting includes the engagement of inlet mating projection 29 against mating surface 31 of housing center section 12. Further, first mating projection 28 is seen to engage generally flat mating surface 34 of outer shell midsection 13. Mating projection 38 is seen to engage shelf-like mating surface 40 of housing midsection 13. Finally, peripheral surface 42 of diffuser outer section 25 is seen to engage peripheral surface 44 of housing outer section 11. These peripheral surfaces 42 and 44 are seen to be generally flat in their complementary engaging surfaces.

Figure 5:
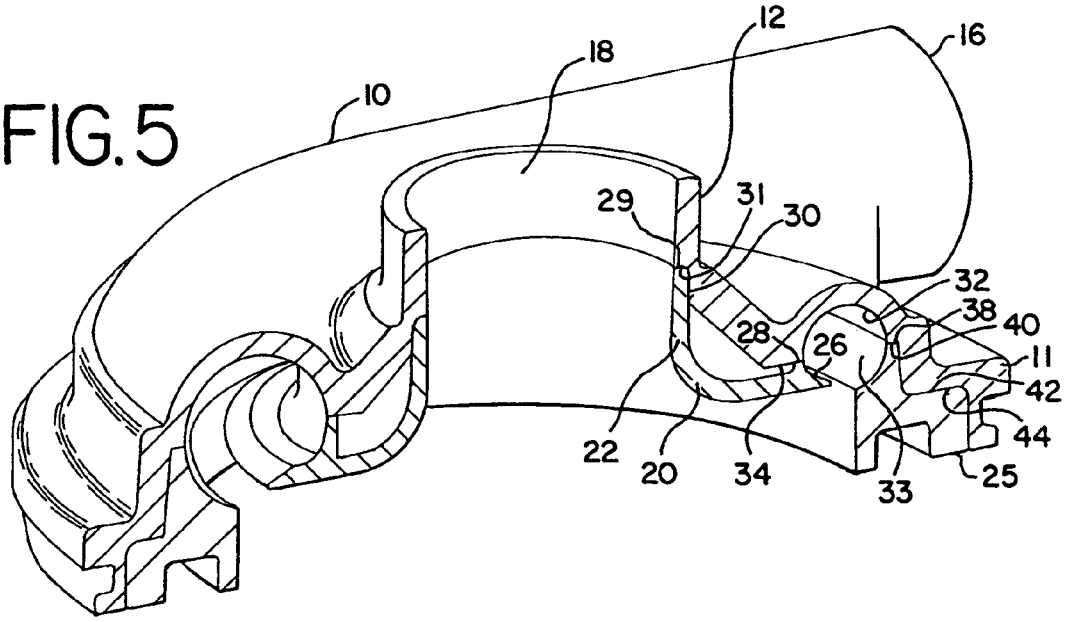
FIG. 5 is a perspective view in cross section of an assembled outer shell and diffuser after machining in accordance with one embodiment of the present invention.

Diffuser transaction section 27 is seen to be present when diffuser 20 is fit into outer shell 10. Referring to the embodiment shown FIG. 5, finished machining has been performed using a means such as a lathe. Accordingly, in the view of FIG. 5, transition section 27 has been removed. Accordingly, diffuser 20 is seen to comprise a unitary section of center section 22 and base section 24, and a unitary outer section 25. Other components of diffuser 20 and outer shell 10 are as described above for FIG. 1.

What is claimed is:

1. A compressor housing for a compressor impeller comprising:

an outer shell including an outer section, a midsection and a center section, the midsection forming an upper volute wall portion of the compressor housing, and the center section forming an inlet concentric with the compressor impeller, a diffuser including a center section, a base section, and an outer section, the center section having a substantially cylindrical outer edge received in a complementary substantially cylindrical mating surface in the outer shell center section, the diffuser base section having a raised first mating projection for engagement with a first mating surface of the midsection of the outer shell, the diffuser outer section having a raised second mating projection for engagement with a second mating surface of the midsection of the outer shell, the outer shell midsection and the diffuser forming a volute wall portion of the compressor housing.

2. The compressor housing of claim 1 wherein the diffuser center section and base section are formed of a first single continuous structure and the diffuser outer section is formed of a second single continuous structure.

3. The compressor housing of claim 1 further comprising a back plate, the back plate formed of a generally circular structure having a generally flat upper surface, the diffuser base section having a generally flat lower surface for engagement with the generally flat upper surface of the back plate, the back plate forming a lower volute wall portion of the compressor housing.

4. The compressor housing of claim 1 wherein the complementary substantially cylindrical mating surface is the outer shell center section is located on an inner wall of the outer shell center section and includes a ledge against which an upper edge of the diffuser center section is engaged.

5. The compressor housing of claim 1 wherein the upper edge of the diffuser center section is a generally circular structure.

6. The compressor housing of claim 1 wherein the first mating surface of the midsection of the outer shell comprises a generally flat surface.

7. The compressor housing of claim 1 wherein the second mating surface of the midsection of the outer shell comprises a ledge against which an upper edge of the diffuser outer section raised second mating projection is engaged.

8. A compressor housing for a compressor impeller comprising:

an outer shell including an outer section, a midsection and a center section, with the center section forming an inlet concentric with the compressor impeller, a diffuser including a center section, a base section and an outer section, the center section having a substantially cylindrical outer edge received in a complementary substantially cylindrical mating surface within the outer shell center section, the diffuser base section having a raised first mating projection for engagement with a first mating surface on the midsection of the outer shell, the diffuser outer section having a raised second mating projection for engagement with a second mating projection for engagement with a second mating surface on the midsection of the outer shell, wherein the diffuser center section and base section are formed of a first continuous structure and the diffuser outer section is formed of a second continuous structure, the outer shell midsection and the diffuser base section and outer section form a volute wall of the compressor housing.

9. The compressor housing of claim 8 further comprising a back plate, the back plate formed of a generally circular structure having a generally flat upper surface, the diffuser base section having a generally flat lower surface for engagement with the generally flat upper surface of the back plate, the back plate forming a lower volute wall portion of the compressor housing.

10. The compressor housing of claim 8 wherein the complementary substantially cylindrical mating surface is the outer shell center section is located on an inner wall of the outer shell center section and includes a ledge against which an upper edge of the diffuser center section is engaged.

11. The compressor housing of claim 8 wherein the upper edge of the diffuser center section is a generally circular structure.

12. The compressor housing of claim 8 wherein the first mating surface of the midsection of the outer shell comprises a generally flat surface.

13. The compressor housing of claim 8 wherein the second mating surface of the midsection of the outer shell comprises a ledge against which an upper edge of the diffuser outer section raised second mating projection is engaged.

14. A method of assembling a compressor housing for a compressor impeller comprising the steps of:

providing an outer shell including an outer section, a midsection and a center section, and having the center section form an inlet concentric with the compressor impeller, providing a diffuser including a center section, a base section and an outer section, with the center section having a generally cylindrical outer edge received in a complementary generally cylindrical mating surface within the outer shell section, the diffuser base section having a raised first mating projection engaging a first mating surface on the midsection of the outer shell, the diffuser outer section having a raised second mating projection engaging a second mating surface on the midsection of the outer shell, the diffuser center section and base section being formed of a first continuous structure and the diffuser outer section is formed of a second continuous structure, wherein the outer shell mid section and the diffuser base section and outer section form a volute wall of the compressor housing.

15. The method of assembling a compressor housing of claim 14 further comprising providing a back plate, the back plate formed of a generally circular structure having a generally flat upper surface, the diffuser base section having a generally flat lower surface for engagement with the generally flat upper surface of the back plate, the back plate forming a lower volute wall portion of the compressor housing.

16. The method of assembling a compressor housing of claim 14 wherein the complementary substantially cylindrical mating surface in the outer shell center section is located on an inner wall of the outer shell center section and includes a ledge against which our upper edge of the diffuser center sections is engaged.

17. The method of assembling a compressor housing of claim 14 wherein the upper edge of the diffuser center section is a generally circular structure.

18. The method of compressor housing of claim 14 wherein the first mating surface of the mid section of the outer shell comprised of a generally flat surface.

19. The method of assembling a compressor housing of claim 14 wherein the second mating surface of the mid section of the outer shell comprises a ledge against which an upper edge of the diffuser outer section raised second mating projection is engaged.

20. A method of assembling a compressor housing for a compressor impeller comprising the steps of:

providing an outer shell including an outer section, a midsection and a center section, and having the center section form an inlet concentric with the compressor impeller, providing a diffuser including a center section, a base section and an outer section, with the center section having a generally cylindrical outer edge received in a complementary generally cylindrical mating surface within the outer shell center section, the diffuser base section having a raised first mating projection engaging a first mating surface on the midsection of the outer shell, the diffuser outer section having a raised second mating projection engaging a second mating surface on the midsection of the outer shell, the diffuser being formed of a unitary structure comprising the center section, base section and outer section, machining the diffuser to remove material between the base section and the outer section to form a first continuous structure comprising the center section and the base section and a second continuous structure comprising the outer section, wherein the outer shell mid section and the diffuser base section and outer section form a volute wall of the compressor housing.

21. The method of assembling a compressor housing of claim 20 further comprising providing a back plate, the back plate formed of a generally circular structure having a generally flat upper surface, the diffuser base section having a generally flat lower surface for engagement with the generally flat upper surface of the back plate, the back plate forming a lower volute wall portion of the compressor housing.

22. The method of assembling a compressor housing of claim 20 wherein the complementary substantially cylindrical mating surface in the outer shell center section is located on an inner wall of the outer shell center section and includes a ledge against which an upper edge of the diffuser center section is engaged.

23. The method of assembling a compressor housing of claim 20 wherein the upper edge of the diffuser center section is a generally circular structure.

24. The method of assembling a compressor housing of claim 20 wherein the first mating surface of the midsection of the outer shell comprises a generally flat surface.

25. The method of assembling a compressor housing of claim 20 wherein the second mating surface of the mid section of the outer shell comprises a ledge against which an upper edge of the diffuser outer section raised second mating projection is engaged.

26. The method of assembling a compressor housing of claim 20 wherein the second mating surface of the midsection of the outer shell comprises a ledge against which an upper edge of the diffuser outer section raised second mating projection is engaged.

27. A method of assembling a compressor housing for a compressor impeller comprising the steps of:

providing an outer shell including an outer section, a mid section and a center section, providing a diffuser including a center section, a base section and an outer section, with the center section received in a complementary mating surface within the outer shell center section, the diffuser base section having a first mating surface engaging a first mating surface on the midsection of the outer shell, the diffuser outer section having a second mating surface engaging a second mating surface on the midsection of the outer shell, the diffuser being formed of a unitary structure comprising the center section, base section and outer section, machining the diffuser to remove material from between the base section and the outer section to form a first continuous structure comprising the center section and the base section and a second continuous structure comprising the outer section, wherein the outer shell midsection and the diffuser base section and outer section form a volute wall of the compressor housing.

28. The method of assembling a compressor housing of claim 27 further comprising providing a back plate, the back plate formed of a generally circular structure having a generally flat upper surface, the diffuser base section having a generally flat lower surface for engagement with the generally flat upper surface of the back plate, the back plate forming a lower volute wall portion of the compressor housing.

29. The method of assembling a compressor housing of claim 27 wherein the complementary substantially cylindrical mating surface in the outer shell center section is located on an inner wall of the outer shell center section is located on an inner wall of the outer shell center section and includes a ledge against which an upper edge of the diffuser center section is engaged.

30. The method of assembling a compressor housing of claim 27 wherein the upper edge of the diffuser center section is a generally circular structure.

31. The method of assembling compressor housing of claim 27 wherein the first mating surface of the mid section of the outer shell comprises a generally flat surface.

* * * * *